US008618344B2

(12) United States Patent
Yadav et al.

(10) Patent No.: US 8,618,344 B2
(45) Date of Patent: Dec. 31, 2013

(54) PROCESS FOR RECOVERY OF PROPYLENE AND LPG FROM FCC FUEL GAS USING STRIPPED MAIN COLUMN OVERHEAD DISTILLATE AS ABSORBER OIL

(75) Inventors: Manoj Yadav, Maharashtra (IN); Sukumar Mandal, Maharashtra (IN); Asit Kumar Das, Maharashtra (IN); Yogesh Gupta, Maharashtra (IN); Minaz Makhania, Maharashtra (IN); Gobind Tulsi, Maharashtra (IN); Shailendra Arora, Maharashtra (IN); Shubhangi Jaguste, Maharashtra (IN)

(73) Assignee: Reliance Industries Limited, Navi Mumbai (IN)

( * ) Notice: Subject to any disclaimer, the term of this patent is extended or adjusted under 35 U.S.C. 154(b) by 0 days.

(21) Appl. No.: 13/380,928

(22) PCT Filed: Jun. 9, 2010

(86) PCT No.: PCT/IN2010/000386

§ 371 (c)(1),
(2), (4) Date: Mar. 26, 2012

(87) PCT Pub. No.: WO2011/001445

PCT Pub. Date: Jan. 6, 2011

(65) Prior Publication Data

US 2012/0172649 A1 Jul. 5, 2012

(30) Foreign Application Priority Data

Jul. 2, 2009 (IN) ..... 1570/MUM/2009

(51) Int. Cl.
*C07C 7/04* (2006.01)

(52) U.S. Cl.
USPC ..... 585/809; 585/802; 208/347; 208/354; 208/355

(58) Field of Classification Search
None
See application file for complete search history.

(56) References Cited

U.S. PATENT DOCUMENTS 4,831,204 A 5/1989 Kushnerick et al.

FOREIGN PATENT DOCUMENTS

WO 00/75263 12/2000
WO 00/75263 A1 12/2000

OTHER PUBLICATIONS

International Preliminary Report on Patentability dated Jan. 12, 2012 and Written Opinion of the International Searching Authority dated Jan. 26, 2011 for Application No. PCT/IN2010/000386.

*Primary Examiner* — Tam M Nguyen
(74) *Attorney, Agent, or Firm* — Ladas & Parry LLP

(57) ABSTRACT

A process is disclosed for enhanced recovery of propylene and LPG from the fuel gas produced in Fluid catalytic cracking unit by contacting a heavier hydrocarbon feed with FCC catalyst. In the conventional process, the product mixture from FCC main column overhead comprising naphtha, LPG and fuel gas, are first condensed and gravity separated to produce unstabilized naphtha, which is subsequently used in the absorber to absorb propylene and LPG from fuel gas. However, the recovery of propylene beyond 97 wt % is difficult in this process since unstabilized naphtha already contains propylene of 5 mol % or above. In the present invention, $C_4$ and lighter components from unstabilized naphtha are first stripped off in a separate column to obtain a liquid fraction almost free from propylene (<0.1 mol %) and other LPG components. Such a stripped liquid fraction, after cooling to 20° C. to 30° C., is used in the absorber to absorb higher amounts of propylene and LPG from fuel gas, leading to improved recovery of propylene.

5 Claims, 1 Drawing Sheet

Figure 1:
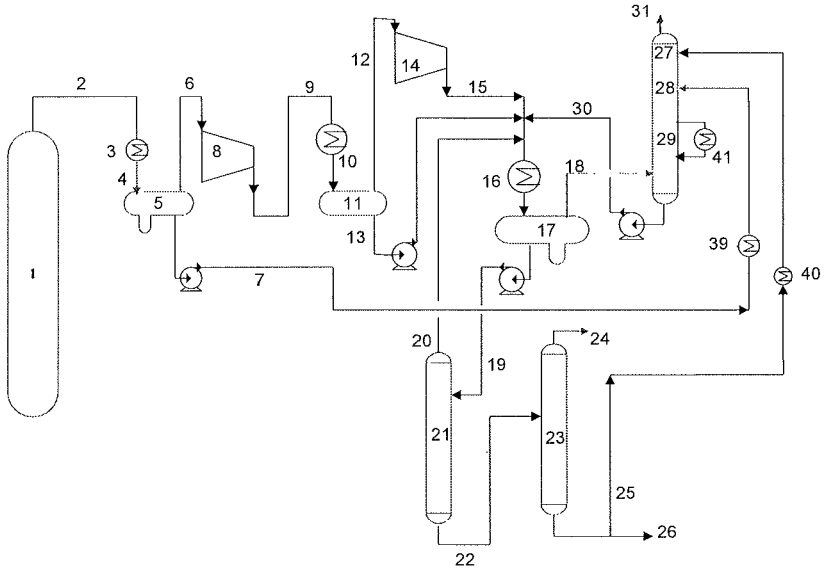
Fig 1 Prior Art

PROCESS FOR RECOVERY OF PROPYLENE AND LPG FROM FCC FUEL GAS USING STRIPPED MAIN COLUMN OVERHEAD DISTILLATE AS ABSORBER OIL

This is a 371 application of PCT/IN2010/000386 filed on Jun. 9, 2010 which claims the benefit of Indian Application No.: 1570/MUM/2009, filed Jul. 2, 2009, the content of which is incorporated herein by reference.

FIELD OF THE INVENTION

The invention relates to a process for the enhanced recovery of propylene and LPG from the fuel gas, produced in Fluid catalytic cracking unit by contacting a heavier hydrocarbon feed with FCC catalyst.

BACKGROUND OF THE INVENTION

Fluid catalytic cracking process comprises of cracking heavier boiling range hydrocarbon streams e.g., vacuum gas oil and residues or mixture thereof in the presence of cracking catalyst at reactor outlet temperature of usually above 500° C. FCC products include hydrocarbons with carbon number 1 to 50 and hence cover entire boiling range starting from fuel gas to residue. FCC reactor product mixture is separated in a main fractionator by distillation.

In the conventional process of propylene and LPG recovery from FCC main column overhead product mixture, the gaseous fraction from the main fractionator condenser/separator is fed to a two stage compressor. The first stage discharge is partially condensed and cooled in inter-stage coolers. The resulting liquid and gaseous fractions are separated in inter-stage receiver. Second stage compressor discharge after combining with the liquid fraction from first-stage receiver is condensed and cooled in second stage high pressure condenser/coolers and received in a high pressure receiver cum separator.

The liquid fraction from high pressure receiver is fed to a de-ethanizer column or $C_2$-stripper where ethane, ethylene and lighter material present in the feed are removed. The overhead vapours from stripper are recycled back to high pressure receiver via high pressure coolers. Bottom product of the stripper is fed to a Debutanizer column where propylene is obtained as a part of the overhead product and the bottoms product thus obtained is referred to as stabilized naphtha.

The gaseous fraction from high pressure receiver is supplied to an absorber. In the absorber, $C_3$—$C_4$ components present in the gaseous feed are preferentially absorbed by an absorber fluid also referred to as absorber oil or lean oil. Overhead liquid from the main fractionator (typically known as unstable naphtha) and debut bottoms liquid (typically known as stabilized naphtha) are commonly used as absorber oil. Typical, temperature of lean oil supplied to the absorber column is between 30 and 40° C. Side coolers are provided to remove heat of absorption from absorber oil. Rich absorber oil from absorber bottom is cooled and supplied to high pressure receiver from where it is fed to de-ethanizer column. Absorber overhead gases flows are further treated to recover any gasoline range material still present in the gas leaving the absorber.

It is found that the propylene recovery in the conventional process is limited up to 97 wt %, which is primarily due to the presence of significant quantity of propylene (>5 mol %) in the unstabilized naphtha stream. This retards the mass transfer of propylene from fuel gas to absorber oil.

U.S. Pat. No. 7,074,323 B2 describes a process to debottleneck the above described conventional process for gas concentration unit wherein unstabilized naphtha, a liquid fraction obtained by cooling the main fractionator overheads and subsequently separating the obtained gaseous and liquid fractions, is separated by distillation into a heavy boiling fraction (Initial boiling point 100-160° C.) and a lighter fraction (Final boiling point 10-160° C.). The lighter fraction after being cooled between 8 to about 25° C. is fed to the absorber while the heavier fraction is directly fed to the debutanizer. This reduces liquid and gas loads on absorber, stripper and debutanizer. However, the recovery of propylene is not much improved since the lighter fraction contains in fact higher percentage of propylene than the original cut before fractionation. Moreover the main objective of the patent was to reduce the load on $C_2$ stripper and Debutanizer section rather than improving propylene recovery.

U.S. Pat. No. 3,893,905 by UOP describes a process to improve propylene recovery wherein a differential condenser rather than the conventional condenser and receiver is used to condense main fractionator overhead vapors for obtaining unstabilized naphtha fraction. Use of this differential condenser minimizes absorption of propylene and $C_4$s in unstabilized naphtha, so that when used as lean oil in the absorber, it absorbs more propylene. The main concept here is to drain the liquid as soon as it is formed by condensation and not let this condensed liquid mix with propylene and lighters present in vapor phase. However, this requires heat exchangers with specially designed baffles which may not operate efficiently over a wide range of feed and other operating conditions and has not been proved in industry. The other option is to supply lean oil at lower temperatures to the absorber which can further reduce propylene and LPG content of the fuel gas. However, this requires chilling of the cooling water system which requires major investment. Another common practice to make the absorber oil leaner is by recycling more of debut bottoms i.e., stabilized naphtha to the absorber, since this recycle is free of propylene and LPG components. But this can not be done in units where any of the absorber, de-ethanizer or debutanizer columns are constrained due to vapor/liquid flooding or due to limited reboiling duties. In fact, in FCC unit with high propylene recovery, these columns are used to the fullest extent for achieving highest propylene separation. Also debut bottom recycle can not be increased in units where cooling duty of debut bottom recycle circuit is already limiting, since the resulting higher temperatures in the absorber will offset the benefit of using leaner oil for higher absorption.

From the above discussion, it is clear that there is a significant economic incentive to develop a FCC process for enhanced LPG and propylene recovery, which will improve the propylene separation from fuel gas beyond 97 wt % but without increasing load in any of existing columns or exchangers in gas concentration section of FCC. The present invention offers a way to enhance the absorption capacity of lean oil used in the absorber without increasing stabilized naphtha i.e. debut bottom recycle to the absorber. Alternately, the invention can be used to deconstrain absorber-stripper-debutanizer by decreasing debut bottom recycle to the absorber.

SUMMARY OF THE INVENTION

The present invention improves the process for recovery of gaseous products from the product mixture obtained by contacting a hydrocarbon feed with a catalyst in a fluid catalytic process. Specifically, it improves a process which recovers propylene and $C_4$s in an absorber using, as lean oil, a liquid fraction obtained by condensing main fractionator overhead vapors into gas-liquid fractions followed by separation into gas and liquid fractions. As absorber oil, this liquid fraction has its capacity limited due to significant amounts of propylene and $C_4$s absorbed in it during its formation in main column overhead condenser. In the improved process these lighter components are stripped off from the above liquid fraction to obtain propylene free liquid fraction which can be used as lean oil to absorb higher amounts of propylene and $C_4$s in the absorber.

The present invention provides an improved process for the recovery of propylene and $C_4$s from a product mixture obtained by contacting a hydrocarbon feed with a catalyst in a fluid catalytic cracking process, wherein said recovery is achieved by following sequence of steps:

(i) distilling the above said product mixture in main fractionator to obtain heavier liquid products as side/bottom draws and a gaseous top product consisting of components boiling below 215° C., (ii) cooling and condensing the gaseous top product and thereafter, separating the obtained gas-liquid mixture in a receiver cum separator to obtain a liquid fraction referred to as 'Unstabilized naphtha' and a lighter gaseous fraction, (iii) sequentially compressing, cooling and separating in a two stage Wet Gas compressor train said gaseous fraction obtained from step (ii) to finally obtain gaseous and liquid fractions from a high pressure separator, (iv) feeding the liquid fraction obtained in step (iii) to a de-ethanizer column wherein Ethane and lighter components stripped off from the feed are recycled back to high pressure receiver in step (iii) whereas the de-ethanized liquid product is fed to debutanizer column, (v) separating butane and lighter components present in the debutanizer feed as overhead gaseous fraction and obtaining heavier fraction as bottom product referred to as debutanizer bottoms, (vi) feeding unstabilized naphtha obtained in step (ii) to a naphtha stripper wherein lighters stripped off from feed are recycled to step (ii) and heavier liquid fraction, after cooling to about 30° C. to 40° C., is used as lean oil in the absorber in step (vii), (vii) contacting gaseous fraction obtained from high pressure separator in step (iii) in an absorber with the liquid fraction as obtained in step (vi) and a part of the debutanizer bottoms as obtained in step (v), (viii) feeding the rich oil from the absorber bottom liquid to de-ethanizer via high pressure receiver, (ix) optionally further treating the gaseous fraction from the absorber before leaving the FCC gas concentration section as Fuel gas;

characterized by further stripping of the unstabilized naphtha as obtained in step (ii), the said stripping achieved by feeding the said unstabilized naphtha as obtained in step (ii) to an intermediate stripper column, wherein lighter components present in the feed are stripped off to obtain a heavier liquid fraction having an initial boiling point of between from about 25° C. to about 50° C. and said heavier fraction, after cooing to about 20° C. to 30° C., is used as lean oil in the absorber in step (vii) and the lighters stripped off from unstabilized naphtha are recycled back to main fractionator overhead condenser in step (ii).

BRIEF DESCRIPTION OF THE ACCOMPANYING DRAWINGS

The present invention will be described with reference to the accompanying drawings in which:

FIG. 1: Schematically depicts the prior art process; and

Figure 2:
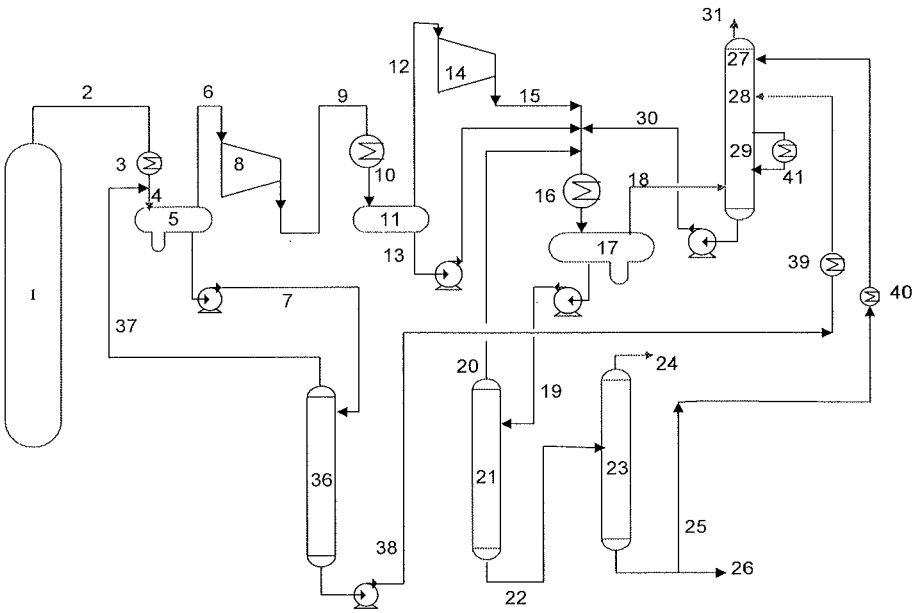

FIG. 2: Illustrates the process of the present invention.

Existing process for recovering gaseous products from the product mixture obtained by contacting a hydrocarbon feed with a catalyst in a fluid catalytic cracking process is shown in FIG. 1. Gaseous mixture from top of main fractionator 1 is supplied to overhead cooler-condenser 3 via gas conduit. Gas-liquid fractions thus obtained are separated in overhead receiver cum separator 5. The separated liquid fraction referred to as unstabilized naphtha is supplied as lean oil in absorber section 28 via liquid conduit 7 after cooling to about 30 to 40° C. in heat exchanger 39. The gaseous fraction is led through conduit 6 to suction of the first stage compressor 8, the discharge stream after getting cooled in inter-stage cooler 10 being separated into gas and liquid fractions in inter-stage receiver 11. This inter-stage liquid fraction, via conduit 13, is combined in conduit 15 with the gaseous fraction compressed in second stage. The combined stream in conduit 15 is further joined by rich oil stream from absorber bottom section 29 via conduit 30 and the overhead gaseous fraction from stripper 21 via conduit 20. The resultant stream is cooled in high pressure cooler 16 and thereafter separated into gas and liquid fractions in high pressure receiver cum separator 17.

The liquid fraction obtained from separator 17 is fed via conduit 19 to a stripper 21 wherein components lighter than ethane are stripped off from the feed and are recycled back to high pressure separator 17 via a sequence consisting of conduit 20, conduit 15 and heat exchanger 16. Bottoms of stripper 21 are fed via conduit 22 to a debutanizer column 23 where components lighter than butane present in the feed are separated as column overheads and are fed further to a propylene separation unit via conduit 24. Part of the debutanizer bottom product, also referred to as stabilized naphtha or debutanized liquid, is cooled to about 30° C. to 40° C. in a heat removal circuit 39 and recycled as lean oil to absorber top section 27 via conduit 25.

Gaseous fraction from the high pressure separator 17, comprising of lighters and $C_3$—$C_5$ components, is fed via conduit 18 to the bottom of absorber wherein $C_3$—$C_5$ components are absorbed by the down-flowing lean absorber oil. Cool stabilized naphtha, being leaner oil than the unstabilized naphtha, is supplied to the top section 27 of the absorber where it contacts with the leanest gas. Cool unstabilized naphtha is supplied at a lower section 28 of the absorber. One or more external cooler(s) 41 at suitable location along the absorber is used to remove heat of absorption from the absorber oil. External coolers return the absorber oil at about 30° C. to 40° C. to the absorber. According to U.S. Pat. No. 7,074,323; $C_3$—$C_5$ absorption can be further improved by supplying unstabilized naphtha at lower temperatures preferably between from about 12° C. to about 20° C. and by further cooling absorber oil in external coolers. This is achieved by using chilled water as an indirect cooling media.

The gaseous fraction obtained from absorber section 27 is supplied via conduit 31 for further treatment before leaving as fuel gas.

FIG. 2 illustrates the process according to the invention wherein the entire or a part of the liquid fraction obtained from main fractionator overhead separator 5 is fed to an additional column referred to as unstabilized naphtha stripper 36 via conduit 7. This naphtha stripper 36 reboils off lighter components from unstabilized naphtha to obtain a bottom liquid fraction having initial boiling point of between from about 25° C. to about 45° C. This liquid fraction referred to as stripped naphtha, after being cooled in heat exchanger 39 to preferably between about 20° C. to about 30° C., is supplied to absorber section 28 via conduit 38. The lighter gaseous fraction obtained from naphtha stripper 36 is recycled back to main fractionator cooler-condenser 3 via conduit 37. The meanings of other notations are same as in FIG. 1.

Propylene and other gaseous components get absorbed in the liquid fraction during the process of condensing main fractionator overheads and remain absorbed in the liquid fraction even after separating the gas and liquid fractions. The obtained liquid fraction is also referred to as unstabilized naphtha. To the extent absorption capacity of unstabilized naphtha is reduced due to the presence of propylene and other gaseous component in it, the same is restored by stripping the unstabilized naphtha in the modified process. Thus, significant improvement in propylene recovery can be achieved by the use of this invention where large amount of $C_3$—$C_4$ components are present in the unstabilized naphtha, this being the case for units where main column overhead receiver is operated at pressures of about 25 psig and above.

The main advantages of the present invention are as follows:

i) Improves propylene and LPG from FCC fuel gas ii) Can deconstrain $C_2$ stripper and debutanizer columns.

The present invention effectively utilizes the additional Wet Gas compressor capacity to improve propylene and LPG recovery without loading the $C_2$ stripper, debutanizer and absorber. The following examples from a simulation study further illustrate the benefits of this invention.

EXAMPLE 1

Improvement in Propylene and LPG Recovery by Using Stripped Naphtha as Lean Oil Propylene recovered by using stripped naphtha as absorber oil is compared with the base case where unstabilized naphtha is used as $1^{st}$ absorber oil. To exclude the effect of cooling on propylene recovery, the temperature of the $1^{st}$ absorber oil-unstabilized naphtha (in base case) and stripped naphtha (in suggested improvement case), is kept same at 32° C. And a constant flow of the $2^{nd}$ absorber oil-debutanizer bottoms recycle, is maintained at same temperature as that of $1^{st}$ absorber oil in all cases shown in Table 1.

The last row of Table 1 shows improvement in propylene recovery due to combined effect of naphtha stripping and cooling of absorber oils to 24° C. by using cooling water from a chiller unit. Improvement is expressed as reduction in propylene content of untreated fuel gas. Saturation level of the lean oil supplied to the absorber is expressed as mole fraction of propylene and other $C_3$—$C_4$ components present in it.

In this example, stripping lowers the total $C_3$ and $C_4$ content of the unstabilized naphtha from 22.8 mol % to 3.8 mol % (stripped naphtha) and makes the absorber oil leaner. This reduces the propylene loss to the untreated fuel gas from 3.3 mol % to 1.9 mol %. Also, the total $C_3$—$C_4$ content in untreated fuel gas is brought down from 4.7 mol % to 2.5 mol %.

TABLE 1

(Flow of the $2^{nd}$ absorber oil i.e. debut bottoms recycle, is kept same for all three cases)

| $1^{st}$ Absorber oil used in the absorber | Un-treated Fuel gas Rate (kmol/hr) | Propylene in $1^{st}$ absorber oil (mol %) | Total $C_3$ + $C_4$ in $1^{st}$ absorber oil (mol %) | Propylene in untreated fuel gas (mol %) | Total $C_3$ + $C_4$ in untreated fuel gas (mol %) |
|---|---|---|---|---|---|
| Un-stabilized naphtha @ 32° C. (Base case) | 1.0M | 5.24 | 22.8 | 3.3 | 4.7 |
| Stripped naphtha @ 32° C. | 0.97M | 0.0 | 3.8 | 1.9 | 2.5 |
| Stripped naphtha @ 24° C. | 0.95M | 0.0 | 3.8 | 0.44 | 0.68 |

EXAMPLE 2

Improvement in Propylene and LPG Recovery by Using Stripped Naphtha At Lower Temperature Stripped naphtha (as well as debut bottom recycle and absorber liquid from inter-stage coolers) is further cooled by about 8° C. using chilled water at about 20° C. Data in Table 1 shows that chilling of lean absorber oil further reduces propylene loss to fuel gas from 1.9 to 0.44 mole % and $C_3$—$C_4$ loss from 2.5 to 0.68 mol %. This represents additional recovery (over the stripped naphtha case) of propylene and LPG from fuel gas due to cooling effect. It is also observed that the benefits of stripping unstabilized naphtha and chilling are additive.

EXAMPLE 3

Improvement in Propylene and LPG Recovery without Loading $C_2$ Stripper, Debutanizer and the Absorber Column by Using Stripped Naphtha in Absorber

TABLE 2

| Liquid load parameter | Unstabilized naphtha as $1^{st}$ lean oil (Base case) | Stripped naphtha as $1^{st}$ lean oil | Increase debut bottom recycle for same recovery as in stripped naphtha case |
|---|---|---|---|
| Propylene in fuel gas, mol % | 3.3 | 1.9 | 1.9 |
| Liquid feed to Absorber | | | |
| Unsaturated naphtha/hr | M1 | 0.0 | M1 |
| Stripped naphtha, T/hr | 0.0 | 0.82 M1 | 0.0 |
| Debut bottom recycle, T/hr | M2 | M2 | 1.43 M2 |
| Total Liquid Load, T/hr | M3 = M1 + M2 | 0.89 M3 | 1.17 M3 |
| Feed to $C_2$ stripper (T/hr) | M4 | 1.002 M4 | 1.10 M4 |
| Feed to Debutanizer (T/hr) | M5 | 1.004 M5 | 1.11 M5 |

As seen from Table 2, use of stripped naphtha has not increased liquid load (and hence vapor load) on $C_2$ stripper, debutanizer and the absorber column while improving propylene recovery in gas concentration section.

The present invention provides a means to improve propylene recovery without loading the vapor-liquid circuit consisting of $C_2$ stripper, debutanizer and the absorber column. Conventionally, propylene recovery can be improved by increasing debut bottom recycle flow to the absorber (and using unstabilized naphtha as such). This approach, after a limited success within the design limits, will ultimately hit vapor-liquid flooding or reboiler/cooling duty limits in any of the $C_2$ stripper, debutanizer and the absorber column. The present invention provides an alternative way of improving propylene recovery without facing such capacity bottlenecks. For example, reducing propylene loss from 3.3 mol % to 1.9 mol % in fuel gas requires additional recycling of debutanizer bottoms of about 43% over the base case as seen by comparing column 1 & 3 of Table 2. This increases liquid loads on absorber, $C_2$ stripper, and debutanizer by about 17, 10 and 11% respectively. In an operating unit this will require substantial de-constraining of the absorber, $C_2$ stripper and debutanizer columns to accommodate the additional vapor-liquid flow. But using the present invention the same improvement in propylene recovery can be achieved without facing any of the capacity bottlenecks .This is evident by comparing liquid flows given in column 1 and 2 of Table 2.

EXAMPLE 4

Effect of Using Stripped Naphtha on $H_2S$ Build-Up in Absorber, $C_2$ Stripper and High Pressure Separator Loop

TABLE 3

| 1st Absorber oil used in the absorber | $H_2S$ content in feed to $C_2$ stripper (mol %) | $H_2S$ content in liquid from Absorber bottom (mol %) |
|---|---|---|
| Unstabilized naphtha @ 32° C. (Base case) | 0.71 | 0.62 |
| Stripped naphtha @ 32° C. | 0.67 | 0.55 |
| Stripped naphtha @ 24° C. | 0.75 | 0.68 |

Use of stripped naphtha in absorber reduces the build up of $H_2S$ in the liquid feed to the stripper. $H_2S$ content of the liquid feed to the $C_2$ stripper is brought down to 0.67 mol % from base value of 0.71 mol % as seen in table 3. This can be explained by lower absorption of H2S in the absorber by use of the stripped naphtha, as reflected in lower $H_2S$ content of liquid coming out from the absorber bottom (0.55 mol % vs 0.62 mol % in base case)

Lowering temperatures along the absorber has reverse effect—$H_2S$ uptake by absorber oil increases. Using chilled water to further cool absorber oil (lean oil and Inter-stage coolers) by about 8° C. increases the build up of $H_2S$ in $C_2$ stripper feed to 0.75 mol % from 0.67 mol % (stripped naphtha @32° C.) as seen in Table 3.

Thus the present invention offers a way to increase absorption of propylene and other $C_3$—$C_4$ components from fuel gas without any build-up of $H_2S$ in the absorber, $C_2$ stripper and high pressure separator loop.

We claim:

1. A process for recovery of propylene and $C_4$s from a product mixture obtained by contacting a hydrocarbon feed with a catalyst in a fluid catalytic cracking process, wherein said recovery is achieved by following sequence of steps:

(i) distilling the above said product mixture in main fractionator to obtain heavier liquid products as side/bottom draws and a gaseous top product consisting of components boiling below 215° C., (ii) cooling and condensing the gaseous top product to obtain gas-liquid mixture and thereafter separating said obtained gas- liquid mixture in a receiver cum separator to obtain a liquid fraction referred to as unstabilized naphtha and a lighter gaseous fraction, (iii) sequentially compressing, cooling and separating in a two stage Wet Gas compressor train said lighter gaseous fraction obtained from step (ii) to finally obtain gaseous and liquid fractions from a high pressure separator, (iv) feeding the liquid fraction obtained in step (iii) to a de-ethanizer wherein ethane and lighter components stripped off from the lighter gaseous fractions are recycled back to high pressure receiver in step (iii) whereas the de-ethanized liquid product is fed to debutanizer column, (v) separating butane and lighter components present in the de-ethanized liquid product as overhead gaseous fraction in the debutanizer column and obtaining heavier fraction as bottom product referred to as debutanizer bottoms, (vi) feeding unstabilized naphtha obtained in step (ii) to a naphtha stripper wherein lighters stripped off from unstabilized naphtha feed are recycled to step (ii) and heavier liquid fraction, after cooling to about 30° C. to 40° C., is used as lean oil in the absorber in step (vii), (vii) contacting gaseous fraction obtained from high pressure separator in step (iii) in an absorber with the liquid fraction as obtained in step (vi) and a part of the debutanizer bottoms as obtained in step (v), (viii) feeding the rich oil from the absorber bottom liquid to de-ethanizer via high pressure receiver, characterized by further stripping of the unstabilized naphtha as obtained in step (ii), said stripping achieved by feeding the unstabilized naphtha as obtained in step (ii) to an intermediate stripper column, wherein lighter components present in the feed are stripped off to obtain a heavier liquid fraction having an initial boiling point of between from about 25° C. to about 50° C. and said heavier fraction, after cooling to about 20° C. to 30° C., is used as lean oil in the absorber in step (vii) and the lighters stripped off from unstabilized naphtha are recycled back to main fractionator overhead condensers in step (ii).

2. The process as claimed in claim 1, wherein the main fractionator overhead condenser pressure is from about 10 psig and above, preferably 25 psig and above.

3. The process as claimed in claim 1 wherein the stripped naphtha is supplied to the absorber at lower temperatures preferably between from about 20° C. to about 30° C. using chilled water as an indirect cooling media wherein recovery of propylene and other $C_3$-$C_4$ components is further improved.

4. The process as claimed in claim 1, wherein the debut bottom recycle and absorber oil from external inter-stage coolers is supplied to absorber at about 20° C. to 30° C. by using chilled water as cooling media in cooling exchangers.

5. A process as claimed in claim 1, wherein the gaseous fraction from the absorber optionally further treated before leaving the FCC gas concentration section as Fuel gas.

* * * * *